US010280498B2

(12) United States Patent
Heck et al.

(10) Patent No.: US 10,280,498 B2
(45) Date of Patent: May 7, 2019

(54) HIGH TEMPERATURE, DAMAGE TOLERANT SUPERALLOY, AN ARTICLE OF MANUFACTURE MADE FROM THE ALLOY, AND PROCESS FOR MAKING THE ALLOY

(71) Applicant: CRS HOLDINGS, INC., Wilmington, DE (US)

(72) Inventors: Karl A. Heck, West Lawn, PA (US); Samuel J. Kernion, Lancaster, PA (US)

(73) Assignee: CRS HOLDINGS, INC., Wilmington, DE (US)

( * ) Notice: Subject to any disclaimer, the term of this patent is extended or adjusted under 35 U.S.C. 154(b) by 273 days.

(21) Appl. No.: 15/291,570

(22) Filed: Oct. 12, 2016

(65) Prior Publication Data

US 2018/0100222 A1 Apr. 12, 2018

(51) Int. Cl.
*C22F 1/10* (2006.01)
*C22C 19/05* (2006.01)

(52) U.S. Cl.
CPC ..... *C22F 1/10* (2013.01); *C22C 19/05* (2013.01); *C22C 19/056* (2013.01)

(58) Field of Classification Search
None
See application file for complete search history.

(56) References Cited

U.S. PATENT DOCUMENTS 3,871,928 A * 3/1975 Smith, Jr. ..... C22F 1/10 148/326
3,898,109 A * 8/1975 Shaw ..... C22F 1/10 148/410
4,006,011 A * 2/1977 Muzyka ..... C22C 19/007 420/586
4,066,447 A * 1/1978 Smith, Jr. ..... C22C 38/52 420/79
4,200,459 A * 4/1980 Smith, Jr. ..... C22C 19/007 420/447
4,685,977 A * 8/1987 Chang ..... C22F 1/10 148/410
4,685,978 A * 8/1987 Smith ..... C22C 38/105 148/328
5,059,257 A * 10/1991 Wanner ..... C21D 6/001 148/326
5,403,547 A * 4/1995 Smith ..... C22C 30/00 420/447
6,521,175 B1 * 2/2003 Mourer ..... C22C 1/0441 148/428
6,730,264 B2 * 5/2004 Cao ..... C22C 19/056 148/428
H2245 H * 8/2010 Heck ..... 148/556
2011/0203707 A1 * 8/2011 Mourer ..... C22C 19/056 148/677
2013/0052077 A1 * 2/2013 Hardy ..... C22C 19/056 420/443
2017/0275736 A1 9/2017 Abe et al.
2018/0223395 A1 * 8/2018 Mourer ..... C22C 19/056

FOREIGN PATENT DOCUMENTS

EP 0421229 4/1991
EP 0787815 8/1997
EP 1666618 A1 * 6/2006
WO WO 2016/052423 A1 * 4/2016

OTHER PUBLICATIONS

International Search Report dated Jan. 18, 2018 for PCT/US2017/055740; 3 pages.*
The Written Opinion of the International Search Authority dated Jan. 18, 2018 for PCT/US2017/055740; 6 pages.*

* cited by examiner

*Primary Examiner* — Helene Klemanski
(74) *Attorney, Agent, or Firm* — Dann, Dorfman, Herrell and Skillman, P.C.

(57) ABSTRACT

A nickel-base alloy is disclosed that has the following weight percent composition.

C about 0.005 to about 0.06
Cr about 13 to about 17
Fe about 4 to about 20
Mo about 3 to about 9
W up to about 8
Co up to about 12
Al about 1 to about 3
Ti about 0.6 to about 3
Nb up to about 5.5
B about 0.001 to about 0.012
Mg about 0.0010 to about 0.0020
Zr about 0.01 to about 0.08
Si up to about 0.7
P up to about 0.05 and the balance is nickel, usual impurities, and minor amounts of other elements as residuals from alloying additions during melting. The alloy provides a combination of high strength, good creep resistance, and good resistance to crack growth. A method of heat treating a nickel base superalloy to improve the tensile ductility of the alloy is also disclosed. An article of manufacture made from the nickel base superalloy described herein is also disclosed.

19 Claims, 3 Drawing Sheets

HIGH TEMPERATURE, DAMAGE TOLERANT SUPERALLOY, AN ARTICLE OF MANUFACTURE MADE FROM THE ALLOY, AND PROCESS FOR MAKING THE ALLOY

BACKGROUND OF THE INVENTION

Field of the Invention

This invention relates generally to nickel-base superalloys and in particular to a nickel base superalloy that provides a novel combination of high strength, good creep strength, and good resistance to crack growth under stress.

Description of Related Art

Structural alloys that are designed to operate at high temperatures (e.g., ≥1100° F.) typically require high strength and creep resistance. However, as the strength and creep resistance properties are increased in such alloys, the alloys can become more susceptible to environmental effects, namely, oxygen in the atmosphere. This susceptibility can manifest itself as notch brittleness and/or an increase in crack growth rate. With regard to crack growth rate, nickel-base superalloys may be tolerant of this type of damage when fatigue cycled at a relatively fast rate, but an increased sensitivity to damage can occur when the alloy is stressed under low frequency with a dwell hold in each stressing/unstressing cycle. One theory for such sensitivity is that the increased dwell time during the stressing part of the cycle provides time for oxygen to diffuse down grain boundaries to form an oxide layer within the crack. That oxide layer then may act as a wedge when the load is released, advancing the crack tip movement at a faster overall rate.

In nickel-base superalloys, the compositional and structural factors that influence strength and creep resistance properties can also affect crack growth rate. Such factors include the effects of solid solution strengthening, precipitation strengthening (such as with the gamma prime (γ') precipitate); anti-phase boundary energy; the volume, sizes, and coherency of the precipitates in the matrix; grain size; grain boundary structure; grain boundary precipitation (composition and morphology); as well as low levels of certain potent elements in the grain boundaries. An alloy that creeps to some extent allows creep relaxation to occur at the crack tip (blunting). The general oxidation resistance of the alloy also influences crack growth rate.

In view of the state of the art as outlined above, it has become desirable to have a nickel-base superalloy that provides not only good high temperature strength and creep resistance, but also improved resistance to crack growth during stress cycling in oxidizing environments.

The known heat treatments for precipitation hardenable (PH) Ni-base superalloys typically include a high temperature annealing treatment to solution discrete phases that precipitate in the alloy matrix material. This solution annealing treatment also relieves stresses in the material and modifies the grain size and structure of the alloy. Annealing temperatures may be termed supersolvus and subsolvus depending on whether the annealing temperature used is above or below the solvus temperature of the γ' precipitate which forms in PH Ni-base superalloys. The solution annealing treatment is followed by a lower temperature aging heat treatment where γ' and γ" phases precipitate. The γ' and γ" phases are the primary strengthening phases in PH Ni-base superalloys. The aging heat treatment may consist of one or two heating steps that are performed at different temperatures that are selected to cause precipitation of γ' and in some cases γ", and to modify the size, morphology, and volume fraction of the γ' and γ" precipitates in the alloy.

BRIEF SUMMARY OF THE INVENTION

The disadvantages of the known alloys described above are overcome to a large degree by a nickel-base superalloy having the following broad, intermediate, and preferred ranges in weight percent.

| | Broad | Intermediate | Preferred |
|---|---|---|---|
| C | 0.005-0.1 | 0.01-0.05 | 0.02-0.04 |
| Cr | 13-17 | 14-16 | 14.5-15.5 |
| Fe | 4-20 | 8-17 | 9-16 |
| Mo | 3-9 | 3.5-8 | 3.8-4.5 |
| W | 0-8 | 0-4 | 0-3 |
| Co | 0-12 | 0-8 | 0-5 |
| Al | 1-3 | 1.5-2.5 | 1.8-2.2 |
| Ti | 0.6-3 | 1-2.5 | 1.5-2.1 |
| Nb + Ta | 0-5.5 | 1-5 | 2-4.5 |
| B | 0.001-0.012 | 0.003-0.010 | 0.004-0.008 |
| Mg | 0.0001-0.0020 | 0.0003-0.0020 | 0.0004-0.0016 |
| Zr | 0.01-0.08 | 0.015-0.06 | 0.02-0.04 |
| Si | 0-0.7% | 0-0.7% | 0-0.7% |
| P | 0-0.05% | 0-0.05% | 0-0.05% |

The balance of the alloy is essentially nickel, usual impurities, such as phosphorus and sulfur, found in precipitation hardenable nickel-base superalloys intended for similar service, and minor amounts of additional elements, such as manganese, which may be present in amounts that do not adversely affect the basic and novel properties provided by this alloy as described hereinbelow.

In accordance with another aspect of this invention there is provided a process of improving the tensile ductility of a nickel-base superalloy article. The process includes the step of providing an intermediate product form, such as bar or rod, that is made from a precipitation hardenable nickel-base superalloy having a composition including elements that can combine to form a gamma prime (γ') precipitate in the alloy. In a first step, the intermediate product form is heated at a temperature above the solvus temperature of the γ' precipitate (the supersolvus temperature) for a time sufficient to take γ' precipitate into solid solution in the alloy. In a second step the intermediate product form is heated at a temperature that is about 10-150° F. below the γ' solvus temperature (the subsolvus temperature) for a time sufficient to cause precipitation and coarsening of γ'. The alloy is then cooled to room temperature from the subsolvus temperature. In a third step the intermediate product form is heated at an aging temperature and for a time sufficient to cause precipitation of fine γ' precipitates. In a preferred embodiment, the third step may comprise a double-age in which the intermediate product form is heated at a first aging temperature, rapidly cooled from the first aging temperature, heated at a second aging temperature lower than said first aging temperature, and then cooling the alloy at a slower rate to room temperature.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of one preferred embodiment can be used with the maximum or minimum for that element from another preferred embodiment. It is further noted that the weight percent compositions described above define the constituents of the alloy that are essential to obtain the combination of properties that characterize the alloy according to this invention. Thus, it is contemplated that the alloy according to the present invention comprises or consists essentially of the elements described above, throughout the following specification, and in the appended claims. Here and throughout this application, unless otherwise indicated, the term percent or the symbol "%" means percent by weight percent or mass percent.

The basic and novel properties provided by the alloy according to this invention and in useful articles made therefrom include high strength, good creep resistance, and good crack growth resistance. Here and throughout this Specification the term "solvus temperature" means the solvus temperature of the γ' precipitate. The term "high strength" as used in the present application means a room temperature yield strength of at least about 120 ksi and a yield strength of at least about 115 ksi when tested at a temperature of 1300° F. The term "good creep resistance" means a stress rupture life of at least about 23 hours when the alloy is tested at 1350° F. with an applied stress of 80 ksi. The term "good crack growth resistance" means a subcritical dwell crack growth rate of not more than about $10^{-3}$ in./cycle when tested at a stress intensity factor range (ΔK) of 40 ksi√in, $5\times10^{-5}$ in./cycle at a ΔK of 20 ksi√in, and crack growth rates between ΔK of 20 ksi√in and ΔK of 40 ksi√in that are not greater than those determined by the equation:

$$da/dN=1.2\times10_{-10}\times\Delta K^{4.3}.$$

BRIEF DESCRIPTION OF THE SEVERAL VIEWS OF THE DRAWINGS

The foregoing summary and the following detailed description of the present invention may be further understood when read in conjunction with the appended drawings, in which.

DETAILED DESCRIPTION OF THE INVENTION

Figure 1:
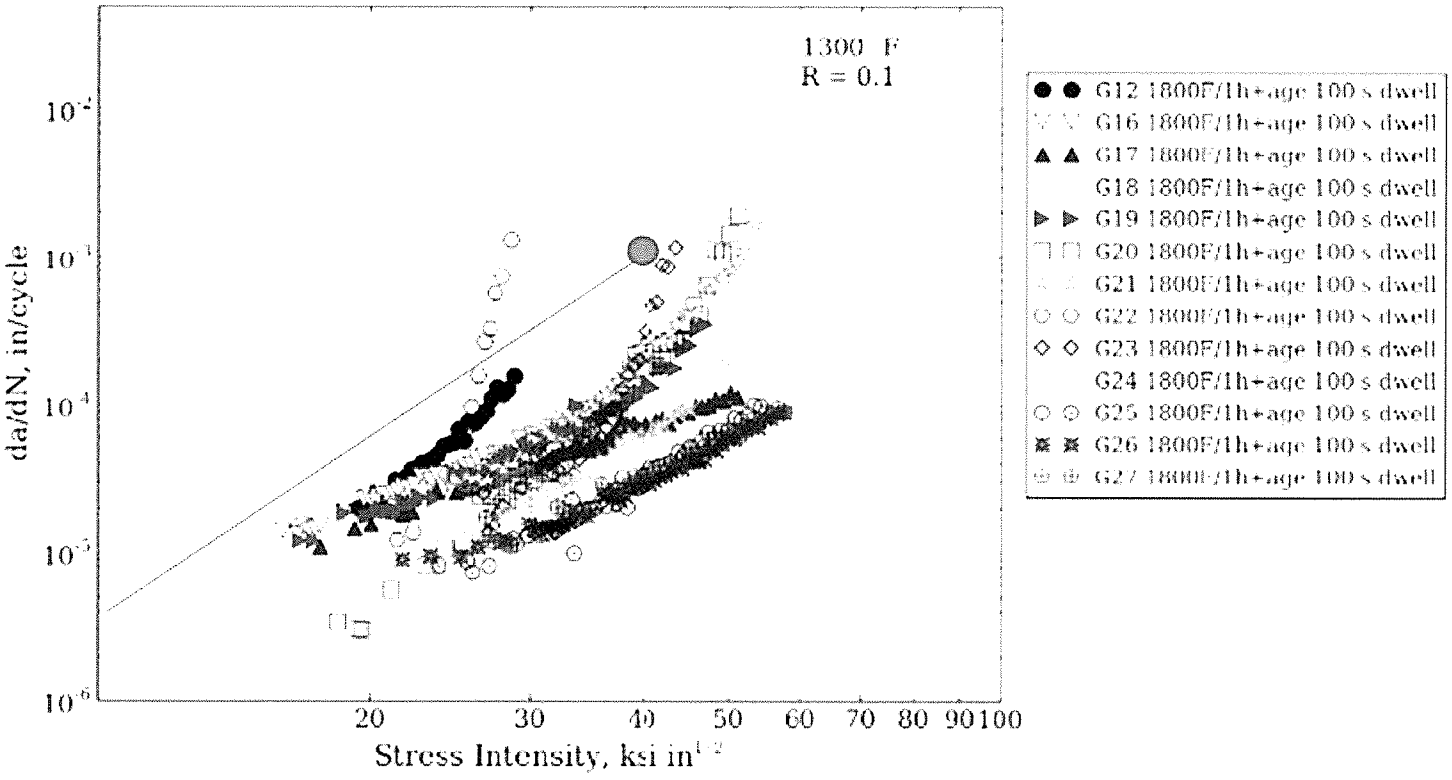
FIG. 1 is a graph of crack growth rate (da/dN) as a function of stress intensity range for a first series of examples that were solution annealed at 1800° F. for 1 hour and then aged.

The concentrations of the elements that constitute the alloy of this invention and their respective contributions to the properties provided by the alloy will now be described.

Carbon: Carbon is present in this alloy because it forms grain boundary carbides that benefit the ductility provided by the alloy. Therefore, the alloy contains at least about 0.005% carbon, better yet at least about 0.01% carbon, and preferably at least about 0.02% carbon. For best results the alloy contains about 0.03% carbon. Up to about 0.1% carbon can be present in this alloy. However, too much carbon can produce carbonitride particles that may adversely affect fatigue behavior. Therefore, carbon is preferably limited to not more than about 0.06%, better yet to not more than about 0.05%, and most preferably to not more than about 0.04% in this alloy.

Chromium: Chromium is beneficial to the oxidation resistance and crack growth resistance provided by this alloy. In order to obtain those benefits the alloy contains at least about 13% chromium, better yet at least about 14% chromium, and preferably at least about 14.5% chromium. For best results, the alloy contains about 15% chromium. Too much chromium results in alloy phase instability as by the formation of a topologically close packed phase during high temperature exposure. The presence of such phase adversely affects the ductility provided by the alloy. Therefore, the alloy contains not more than about 17% chromium, better yet not more than about 16% chromium, and preferably not more than about 15.5% chromium.

Molybdenum: Molybdenum contributes to the solid solution strength and good toughness provided by this alloy. Molybdenum benefits the crack growth resistance when the alloy contains very little or no tungsten. For those reasons, the alloy contains at least about 3% molybdenum, better yet at least about 3.5% molybdenum, and preferably at least about 3.8% molybdenum. Too much molybdenum in the presence of chromium can adversely affect the phase balance of this alloy because, like chromium, it can cause the formation of a topologically close packed phase that adversely affects the ductility of the alloy. For that reason, contains not more than about 9%, better yet not more than about 8%, and preferably not more than about 4.5% molybdenum.

Iron: The alloy according to this invention contains at least about 4% iron in substitution for some of the nickel and for some of the cobalt when cobalt is present in the alloy. The presence of iron in substitution for some of the nickel results in a lowering of the solvus temperature for the γ' and γ" precipitates such that the solution annealing of the alloy can be performed at a lower temperature than when the alloy contains no iron. It is believed that a lower solvus temperature may be beneficial to the thermomechanical processability of this alloy. Therefore, the alloy preferably contains at least about 8% iron, and better yet at least about 9% iron. When the alloy contains too much iron the crack growth resistance provided by the alloy is adversely affected especially when tungsten is present in the alloy. Accordingly, the alloy contains not more than about 20% iron, better yet not more than about 17% iron, and preferably not more than about 16% iron.

Cobalt: Cobalt is optionally present in this alloy because it benefits the creep resistance provided by the alloy. However, the inventors have discovered that too much cobalt in the alloy has an adverse effect on the crack growth resistance property. Therefore, when cobalt is present in this alloy it is restricted to not more than about 12%, better yet to not more than about 8%, and preferably to not more than about 5%.

Aluminum: Aluminum combines with nickel and iron to foim the γ' precipitates that benefit the high strength provided by the alloy in the solution annealed and aged condition. Aluminum has also been found to work synergistically with chromium to provide improved oxidation resistance compared to the known alloys. Aluminum is also beneficial for stabilizing the γ' precipitates so that the γ' does not transform to the eta phase or to the delta phase when the alloy is overaged. For those reasons the alloy contains at least about 1% aluminum, better yet at least about 1.5% aluminum, and preferably at least about 1.8% aluminum.

Too much aluminum can result in segregation that adversely affects the processability of the alloy, for example, the hot workability of the alloy. Therefore, aluminum is limited to not more than about 3%, better yet to not more than about 2.5%, and preferably to not more than about 2.2% in this alloy.

Titanium: Titanium, like aluminum, contributes to the strength provided by the alloy through the formation of the γ' strengthening precipitate. Accordingly, the alloy contains at least about 0.6% titanium, better yet at least about 1% titanium, and preferably at least about 1.5% titanium. Too much titanium adversely affects the crack growth resistance property of the alloy. Titanium causes rapid age hardening and can adversely affect thermo-mechanical processing and welding of the alloy. Therefore, the alloy contains not more than about 3% titanium, better yet not more than about 2.5% titanium, and preferably not more than about 2.1% titanium.

Niobium: Niobium is another element that combines with nickel, iron, and/or cobalt to for γ'. Although niobium is optionally present in this alloy, the alloy preferably contains at least about 1% niobium and better yet at least about 2% niobium to benefit the very high strength provided by the alloy in the solution annealed and aged condition. When the alloy contains less than about 1% aluminum, the niobium-enriched strengthening phase is more likely to transform to undesired delta phase when the alloy is overaged. That phenomenon is more pronounced when iron is present in this alloy. The presence of delta phase can limit the service temperature of the alloy to about 1200° F. which is insufficient for many gas turbine applications. As described above the alloy contains enough Al to prevent delta phase formation if the alloy is overaged at a temperature higher than 1200° F. When present, niobium is limited to not more than about 5.5%, better yet to not more than about 5%, and preferably to not more than about 4.5% in this alloy. Tantalum may be substituted for some or all of the niobium, when niobium is intentionally present in this alloy.

Tungsten: Tungsten is optionally present in the alloy of this invention to benefit the strength and creep resistance provided by this alloy. High levels of tungsten adversely affect the dwell crack growth resistance provided by the alloy. The alloy is more crack growth tolerant of tungsten when tungsten is present in place of some of the niobium. Accordingly, when present, tungsten is limited to not more than about 8% tungsten, better yet to not more than about 4% tungsten, and preferably to not more than about 3% in this alloy.

Boron, Magnesium, Zirconium, Silicon, and Phosphorus: Up to about 0.015% boron can be present in this alloy to benefit the high temperature ductility of the alloy thereby making the alloy better suited for hot working. Preferably, the alloy contains about 0.001-0.012% boron, better yet about 0.003-0.010% boron, and most preferably about 0.004-0.008% boron. Magnesium is present as a deoxidizing and desulfurizing agent. Magnesium also appears to benefit the crack growth resistance provided by the alloy by tying up sulfur. For those reasons the alloy contains about 0.0001-0.005% magnesium, better yet about 0.0003-0.002% magnesium, and preferably about 0.0004-0.0016% magnesium. It was found that for this alloy a small position addition of zirconium is beneficial for good hot working ductility to prevent cracking during hot forging of ingots made from the alloy. In that regard, the alloy contains at least about 0.001% zirconium. Preferably, the alloy contains about 0.01-0.08% zirconium, better yet about 0.015-0.06% zirconium, and most preferably about 0.02-0.04% zirconium. For best results, the alloy contains about 0.03% zirconium. Silicon is believed to benefit the notch ductility of this alloy at elevated temperatures. Therefore, up to about 0.7% silicon can be present in the alloy for such purpose. Although phosphorus is typically considered to be an impurity element, a small amount of phosphorus, up to about 0.05%, can be included to benefit the stress rupture properties provided by this alloy when niobium is present.

The balance of the alloy composition is nickel and the usual impurities found in commercial grades of nickel-base superalloys intended for similar service or use. Also included in the balance are residual amounts of other elements such as manganese that are not intentionally added, but which are introduced through charge materials used to melt the alloy. Preferably the alloy contains at least about 58% nickel for a good overall combination of properties (strength, creep resistance, and crack growth resistance). It was discovered that the alloy has a lower gamma prime solvus temperature when the alloy contains nickel in the lower portion of the nickel range. Therefore, for a selected amount of aluminum, titanium, and niobium in this alloy, the annealing temperature to obtain a particular grain size and combination of properties is based somewhat on nickel content.

In order to provide the basic and novel properties that are characteristic of the alloy, the elements are preferably balanced by controlling the weight percent concentrations of the elements molybdenum, niobium, tungsten, and cobalt. More particularly, when the alloy contains less than 0.1% niobium, the combined amounts of molybdenum and tungsten are greater than about 7%, and the alloy is to be annealed at a temperature greater than the γ' solvus temperature, then cobalt is restricted to less than 9%. When the alloy contains at least 0.1% niobium, then the alloy is preferably balanced such that the γ' solvus temperature is not greater than about 1860° F. and the alloy is preferably processed to provide a grain size that is as coarse as practicable.

The alloy of this invention is preferably produced by vacuum induction melting (VIM). When desired, the alloy may be refined by a double melting process in which the VIM ingot is remelted by electroslag remelting (ESR) or by vacuum arc remelting (VAR). For the most critical applications, a triple-melt process consisting of VIM followed by ESR and then VAR can be used. After melting, the alloy is cast as one or more ingots that are cooled to room temperature to fully solidify the alloy. Alternatively, the alloy can be atomized to form metal powder after the primary melting (VIM). The alloy powder is consolidated to form intermediate product forms such as billets and bars that can be used to manufacture finished products. The alloy powder is preferably consolidated by loading the alloy powder into a metal canister and then hot isostatically pressing (HIP) the metal powder under conditions of temperature, pressure, and time sufficient to fully or substantially fully consolidate the alloy powder into a canister ingot.

The solidified ingot, whether cast or HIP'd, is preferably homogenized by heating at about 2150° F. for about 24 hours depending on the cross-sectional area of the ingot. The alloy ingot can be hot worked to an intermediate product form by forging or pressing. Hot working is preferably carried out by heating the ingot to an elevated starting temperature of about 1900-2100° F., preferably about 2050-2075° F. If additional, reduction in cross-sectional area is needed, the alloy must be reheated to the starting temperature before additional hot working is performed.

The tensile and creep strength properties that are characteristic of the alloy according to this invention are developed by heat treating the alloy. In this regard, the as-worked alloy is preferably solution annealed at the supersolvus temperature as defined above. Therefore, in general, the alloy is preferably heated at a supersolvus temperature of about 1850-2100° F. for a time sufficient to dissolve substantially all intermetallic precipitates in the matrix alloy material. Alternatively, when the alloy contains more than 0.1% niobium, the alloy can be annealed at a temperature below the γ' solvus temperature. When the γ' solvus temperature of the alloy is greater than about 1880° F., then tungsten is preferably restricted to not more than about 1% when the alloy is to be annealed at the subsolvus temperature. The time at temperature depends on the size of the alloy product form and is preferably about 1 hour per inch of thickness. The alloy is cooled to room temperature at a rate that is sufficiently fast to retain the dissolved precipitates in solution.

After the solution annealing heat treatment, the alloy is subjected to an aging treatment that causes the precipitation of the strengthening phases in the alloy. Preferably, the aging treatment includes a two-step process. In a first or stabilizing step the alloy is heated at a temperature of about 1500-1550° F. for about 4 hours and then cooled to room temperature by water quenching or air cooling depending on the section size of the alloy part. In a second or precipitation step the alloy is heated at a temperature of about 1350-1400° F. for about 16 hours and then cooled in air to room temperature. Although the two-step aging treatment is preferred, the aging treatment can be conducted in a single step in which the alloy is heated at a temperature of about 1400° F. for about 16 hours and then cooled in air to room temperature.

In the solution-treated and aged condition, the alloy provides a room temperature yield strength of at least about 120 ksi and an elevated temperature yield strength (1300° F.) of at least about 115 ksi. The foregoing tensile yield strengths are provided in combination with good creep resistance as defined by a stress rupture strength of at least about 23 hours when tested at 1350° F. and an applied stress of 80 ksi.

The alloy according to this invention when heat treated as described above has a relatively coarse-grained microstructure that benefits the stress rupture property (creep strength). In connection with the invention described herein, the term "coarse-grained" means an ASTM grain size number of 4 or coarser as determined in accordance with ASTM Standard Test Method E-112. However, the inventors discovered that the coarse-grained microstructure may result in an undesirable reduction in the tensile ductility provided by the alloy in the single-solution-treated and aged condition. Therefore, in connection with the development of the alloy, the inventors developed a modified heat treatment to overcome the loss in tensile ductility that otherwise results when the alloy is heat treated as described above.

The modified heat treatment according to the present invention includes a two-step annealing procedure. In the first step, the alloy is solution annealed by heating at a supersolvus temperature of about 1850-2100° F. as described above. The time at temperature is preferably about 0.5-4 hours depending on the size and cross-sectional area of the alloy product. The alloy is cooled from the supersolvus temperature to room temperature as described above. In the second step, the alloy is heated at a subsolvus temperature that is about 10° F. to about 150° F. below the γ' solvus temperature of the alloy. The alloy is preferably held at the subsolvus temperature for about 1-8 hours, again depending on the size and cross-sectional area of the alloy product. The alloy is then cooled to room temperature before the aging heat treatment is performed as described above. The inventors believe that the subsolvus annealing step causes the precipitation of γ' that coarsens into sizes that are large relative to the finer-sized γ' that is precipitated during the aging treatment. The combination of the coarsened and fine-sized γ' is believed to benefit the tensile ductility provided by the alloy because the coarser γ' precipitates are more stable during the elevated temperatures experienced by the alloy when used in elevated temperature service. The coarsened γ' also consumes a portion of the aluminum, titanium, and niobium in the alloy, thereby limiting the total amount of the finer-sized γ' that precipitates during the aging treatment and when the alloy is in elevated temperature service. The resulting restriction on the overall amount of the γ' precipitate in the alloy limits the peak strength and stress rupture life provided by the alloy to an acceptable degree, but also reduces precipitation and coarsening of undesirable brittle phases that otherwise would adversely affect the tensile ductility provided by the alloy.

WORKING EXAMPLES

The following examples are presented in order to demonstrate the combination of properties that characterize the alloy according to this invention.

Example I

In order to demonstrate the novel combination of properties provided by the alloy according to this invention, several small heats were vacuum induction melted and cast as 40 lb., 4-in. square ingots. The weight percent compositions of the ingots are set forth in Table 1 below. The balance of each heat was nickel and a residual amount of zirconium resulting from an addition of 0.03% Zr during melting.

All of the ingots were homogenized at 2150° F. for 24 hours. The "S" heats were forged from a starting temperature of 2150° F. to 1.75-in. square bar, cut in half, reheated to 2150° F., and then forged to 0.8 in.×1.4 in. rectangular cross section bars. The "G" heats were forged from a starting temperature of 2050-2075° F. to 1.75-in. square bar, cut in half, reheated to 2150° F., and then forged to 0.8 in.×1.4 in. rectangular cross section bars.

TABLE 1

| | Heat | C | Cr | Ni | Mo | W | Co | Al | Ti | Nb | B | Fe | Mg |
|---|---|---|---|---|---|---|---|---|---|---|---|---|---|
| Inv.[1] | S31 | 0.025 | 14.97 | 58.06 | 8.01 | 0.01 | 0.01 | 1.00 | 3.00 | <0.01 | 0.0053 | 14.90 | 0.0015 |
| | S32 | 0.021 | 15.02 | 57.97 | 8.01 | <0.01 | <0.01 | 2.96 | 0.60 | <0.01 | 0.0050 | 15.38 | 0.0016 |
| | S66 | 0.038 | 15.00 | 57.86 | 4.02 | 3.98 | <0.01 | 1.99 | 1.80 | <0.01 | 0.0053 | 15.34 | <0.001 |
| | G16 | 0.032 | 14.95 | 62.87 | 4.01 | 2.94 | 0.10 | 1.98 | 1.79 | 1.03 | 0.0047 | 10.25 | 0.0004 |
| | G17 | 0.032 | 15.06 | 62.85 | 3.98 | 1.98 | 0.01 | 1.98 | 1.73 | 1.98 | 0.0051 | 10.35 | 0.0007 |
| | G18 | 0.032 | 14.96 | 62.93 | 4.00 | 1.00 | <0.01 | 2.00 | 1.73 | 2.97 | 0.0046 | 10.33 | 0.0011 |
| | G19 | 0.033 | 14.97 | 62.98 | 4.00 | 0.01 | <0.01 | 1.97 | 1.72 | 3.97 | 0.0049 | 10.30 | 0.0014 |

TABLE 1-continued

| | Heat | C | Cr | Ni | Mo | W | Co | Al | Ti | Nb | B | Fe | Mg |
|---|---|---|---|---|---|---|---|---|---|---|---|---|---|
| | G20 | 0.030 | 14.90 | 58.08 | 3.86 | 3.09 | 9.95 | 1.95 | 1.84 | 1.02 | 0.0053 | 5.25 | 0.0005 |
| | G24 | 0.034 | 15.03 | 57.89 | 4.01 | 2.93 | 0.13 | 1.97 | 1.79 | 1.04 | 0.0049 | 15.13 | 0.0004 |
| | G25 | 0.034 | 15.02 | 57.83 | 3.99 | 1.99 | 0.01 | 1.97 | 1.79 | 2.01 | 0.0058 | 15.31 | 0.0006 |
| | G26 | 0.030 | 14.99 | 57.91 | 4.00 | 1.00 | <0.01 | 1.96 | 1.78 | 2.99 | 0.0053 | 15.28 | 0.0009 |
| | G27 | 0.032 | 15.06 | 58.07 | 4.00 | 0.02 | <0.01 | 2.01 | 1.76 | 3.68 | 0.0051 | 15.33 | 0.0015 |
| Comp.[2] | S25 | 0.022 | 9.99 | 62.81 | 7.99 | <0.01 | <0.01 | 0.95 | 2.96 | <0.01 | 0.0046 | 15.23 | 0.0012 |
| | S26 | 0.024 | 10.03 | 62.85 | 8.00 | 0.01 | <0.01 | 2.94 | 0.61 | <0.01 | 0.0046 | 15.51 | 0.0015 |
| | S27 | 0.028 | 9.96 | 63.12 | 7.99 | <0.01 | 9.95 | 1.00 | 2.97 | <0.01 | 0.0047 | 4.97 | 0.0015 |
| | S28 | 0.024 | 10.02 | 62.87 | 4.02 | 3.96 | <0.01 | 1.97 | 1.80 | <0.01 | 0.0048 | 15.31 | 0.0006 |
| | S29 | 0.025 | 10.03 | 62.77 | 0.00 | 7.98 | <0.01 | 1.00 | 3.07 | <0.01 | 0.0045 | 15.12 | 0.0011 |
| | S30 | 0.026 | 10.00 | 63.00 | 4.01 | 3.98 | 10.04 | 1.97 | 1.80 | <0.01 | 0.0049 | 5.17 | 0.0014 |
| | S33 | 0.025 | 14.90 | 58.25 | 8.00 | <0.01 | 9.98 | 0.98 | 2.98 | <0.01 | 0.0049 | 4.87 | 0.0014 |
| | S34 | 0.023 | 14.94 | 58.18 | 7.98 | <0.01 | 9.97 | 2.97 | 0.60 | <0.01 | 0.0055 | 5.34 | 0.0014 |
| | S37 | 0.024 | 10.06 | 62.78 | <0.01 | 7.97 | 0.01 | 2.98 | 0.60 | <0.01 | 0.0052 | 15.57 | 0.0013 |
| | S38 | 0.026 | 10.01 | 63.04 | <0.01 | 7.96 | 10.06 | 1.02 | 3.06 | <0.01 | 0.0045 | 4.82 | 0.0014 |
| | S39 | 0.026 | 10.02 | 63.10 | <0.01 | 7.98 | 10.07 | 2.98 | 0.59 | <0.01 | 0.0045 | 5.23 | 0.0015 |
| | S40 | 0.025 | 9.99 | 63.15 | 8.01 | 0.01 | 10.02 | 2.96 | 0.60 | <0.01 | 0.0046 | 5.26 | 0.0015 |
| | S67 | 0.035 | 14.95 | 58.12 | 4.03 | 3.99 | 9.93 | 1.97 | 1.80 | <0.01 | 0.0045 | 5.22 | <0.001 |
| | S68 | 0.030 | 14.89 | 58.07 | 0.03 | 7.98 | 10.01 | 1.00 | 3.04 | <0.01 | 0.0038 | 4.99 | 0.0010 |
| | S69 | 0.029 | 15.05 | 57.82 | <0.01 | 8.00 | 0.06 | 2.98 | 0.63 | <0.01 | 0.0042 | 15.46 | 0.0010 |
| | S70 | 0.030 | 15.02 | 58.52 | <0.01 | 8.00 | 10.01 | 2.98 | 0.07 | <0.01 | 0.0042 | 5.40 | 0.0010 |
| | S44 | 0.030 | 14.96 | 58.06 | <0.01 | 8.01 | 10.03 | 0.98 | 3.04 | <0.01 | 0.0051 | 4.88 | 0.0013 |
| | G12 | 0.034 | 14.90 | 63.00 | 3.95 | 3.03 | 10.01 | 1.94 | 1.78 | 0.99 | 0.0048 | 0.32 | 0.0004 |
| | G13 | 0.032 | 14.92 | 63.07 | 4.00 | 1.99 | 9.99 | 1.96 | 1.78 | 1.99 | 0.0047 | 0.22 | 0.0007 |
| | G14 | 0.033 | 14.92 | 63.07 | 4.00 | 1.00 | 10.00 | 1.97 | 1.78 | 2.98 | 0.0047 | 0.22 | 0.0009 |
| | G15 | 0.033 | 14.89 | 63.11 | 3.99 | 0.02 | 9.99 | 1.97 | 1.78 | 3.97 | 0.0042 | 0.22 | 0.0012 |
| | G21 | 0.032 | 14.89 | 58.06 | 4.00 | 1.99 | 9.99 | 1.96 | 1.79 | 2.01 | 0.0052 | 5.24 | 0.0007 |
| | G22 | 0.033 | 14.93 | 58.04 | 3.98 | 1.00 | 10.00 | 1.97 | 1.78 | 3.00 | 0.0046 | 5.23 | 0.0010 |
| | G23 | 0.034 | 14.71 | 58.72 | 3.93 | 0.01 | 9.80 | 1.92 | 1.75 | 3.94 | 0.0051 | 5.15 | 0.0013 |

[1]Invention
[2]Comparative

Standard tensile test specimens and standard test specimens in accordance with ASTM Standard Specification E399 for dwell crack growth testing were prepared from the as-forged bars. The specimens were heat treated as set forth in Table 2 below.

TABLE 2

| Alloy | Solution Treatment | Aging Treatment |
|---|---|---|
| "G" (H1) | 1800 F./1 h/OQ | 1550 F./4 h/AC + 1350 F./16 h/AC |
| "G" (H2) | 2075 F./1 h/OQ | 1550 F./4 h/AC + 1350 F./16 h/AC |
| "S" | 1850 F./1 h/OQ | 1550 F./4 h/AC + 1350 F./16 h/AC |

The results of room temperature tensile testing are set forth in Table 3A below including the 0.2% offset yield strength (YS), the ultimate tensile strength (UTS), the percent elongation (% El), and the percent reduction in cross-sectional area (% RA). The results set forth in Table 3A include tests performed after heat treatment and tests perfoiined after the samples were heated at 1300° F. for 1000 hrs.

TABLE 3A

| | | | | | | 1300 F./1000 hrs | | | |
|---|---|---|---|---|---|---|---|---|---|
| | HEAT | YS | UTS | % El | % RA | YS | UTS | % El | % RA |
| Inv. | S31 | 143.03 | 204.67 | 16.63 | 15.50 | 148.97 | 204.63 | 8.00 | 9.19 |
| (H1) | S32 | 121.34 | 179.18 | 23.50 | 33.79 | 131.26 | 188.88 | 16.30 | 28.15 |
| | S66 | 136.61 | 193.54 | 26.14 | 34.85 | | Not Tested | | |
| | G16 | 170.64 | 208.65 | 18.22 | 44.67 | 171.06 | 210.64 | 19.40 | 48.41 |
| | G17 | 178.60 | 216.21 | 10.59 | 42.88 | 174.07 | 211.34 | 16.70 | 42.70 |
| | G18 | 184.64 | 221.64 | 16.24 | 46.47 | 186.31 | 222.39 | 16.87 | 34.03 |
| | G19 | 124.51 | 213.85 | 18.71 | 26.18 | 111.99 | 210.20 | 9.60 | 10.52 |
| | G20 | 161.70 | 205.55 | 24.36 | 41.86 | 156.86 | 200.99 | 19.10 | 37.24 |
| | G24 | 161.73 | 203.76 | 21.19 | 44.63 | 146.93 | 190.25 | 7.80 | 32.75 |
| | G25 | 162.90 | 203.60 | 8.71 | 36.13 | 162.43 | 209.91 | 11.60 | 34.05 |
| | G26 | 168.66 | 212.62 | 9.11 | 31.55 | 164.94 | 216.82 | 14.16 | 34.85 |
| | G27 | 173.25 | 219.87 | 11.29 | 17.16 | 155.88 | 210.03 | 12.30 | 16.17 |
| Comp. | S25 | 115.46 | 188.02 | 29.11 | 46.36 | 119.73 | 189.12 | 22.30 | 30.50 |
| | S26 | 111.45 | 172.65 | 27.33 | 49.42 | 117.64 | 174.93 | 25.00 | 46.35 |
| | S27 | 119.16 | 190.87 | 30.50 | 47.14 | 129.01 | 194.18 | 28.80 | 47.30 |
| | S28 | 125.30 | 187.66 | 26.10 | 53.10 | 126.43 | 186.66 | 23.90 | 41.92 |
| | S29 | 124.82 | 194.69 | 23.76 | 46.39 | 131.03 | 195.64 | 23.10 | 48.65 |
| | S30 | 132.32 | 193.56 | 25.40 | 50.79 | 134.06 | 192.72 | 26.50 | 46.72 |
| | S33 | 126.61 | 200.41 | 27.62 | 34.10 | 133.19 | 195.12 | 12.60 | 15.90 |
| | S34 | 130.90 | 187.56 | 17.80 | 45.68 | 133.44 | 190.52 | 26.30 | 49.59 |
| | S37 | 131.66 | 190.03 | 23.96 | 43.62 | 137.39 | 190.55 | 22.48 | 46.39 |

TABLE 3A-continued

| | | | | | 1300 F./1000 hrs | | | |
|---|---|---|---|---|---|---|---|---|
| HEAT | YS | UTS | % El | % RA | YS | UTS | % El | % RA |
| S38 | 132.72 | 198.25 | 26.14 | 53.02 | 139.14 | 199.38 | 24.75 | 49.51 |
| S39 | 128.98 | 198.41 | 24.60 | 45.76 | 133.99 | 191.38 | 23.50 | 41.44 |
| S40 | 125.91 | 186.81 | 25.60 | 34.49 | 128.45 | 187.29 | 27.60 | 50.87 |
| S67 | 132.07 | 192.34 | 29.11 | 48.21 | | Not Tested | | |
| S68 | 134.10 | 198.92 | 27.13 | 44.80 | | Not Tested | | |
| S69 | 138.88 | 183.89 | 21.88 | 48.37 | | Not Tested | | |
| S70 | 131.08 | 186.15 | 25.74 | 54.31 | | Not Tested | | |
| S44 | 143.55 | 208.28 | 20.10 | 39.93 | 144.14 | 205.03 | 22.08 | 37.59 |
| G12 | 175.48 | 212.95 | 21.98 | 52.21 | 180.00 | 220.92 | 22.57 | 42.97 |
| G13 | 160.91 | 212.84 | 25.45 | 47.72 | | Not Tested | | |
| G14 | 173.66 | 218.37 | 11.49 | 34.31 | 162.92 | 216.70 | 19.80 | 32.75 |
| G15 | 147.40 | 208.31 | 17.82 | 20.03 | | Not Tested | | |
| G21 | 166.80 | 210.04 | 19.60 | 41.58 | 175.26 | 220.48 | 21.40 | 48.00 |
| G22 | 177.52 | 222.62 | 13.10 | 45.17 | 168.89 | 217.99 | 16.60 | 37.14 |
| G23 | 163.62 | 215.16 | 17.10 | 23.30 | 155.25 | 220.27 | 16.40 | 22.54 |

The results of additional room temperature tensile testing of the G-heat samples that were heat treated with H2 are set forth in Table 3B below including the 0.2% offset yield strength (YS), the ultimate tensile strength (UTS), the percent elongation (% El), and the percent reduction in cross-sectional area (% RA).

TABLE 3B

| | | | | | | 1300 F./1000 hrs | | | |
|---|---|---|---|---|---|---|---|---|---|
| | HEAT | YS | UTS | % El | % RA | YS | UTS | % El | % RA |
| Inv. | G16 | 170.64 | 208.65 | 18.22 | 44.67 | 118.13 | 167.97 | 9.80 | 12.18 |
| (H2) | G17 | 178.60 | 216.21 | 10.59 | 42.88 | 123.51 | 174.80 | 10.00 | 12.13 |
| | G18 | 184.64 | 221.64 | 16.24 | 46.47 | 135.58 | 192.50 | 13.80 | 12.41 |
| | G19 | 124.51 | 213.85 | 18.71 | 26.18 | 141.19 | 203.83 | 16.00 | 17.09 |
| | G20 | 161.70 | 205.55 | 24.36 | 41.86 | 121.87 | 175.10 | 14.40 | 13.48 |
| | G24 | 161.73 | 203.76 | 21.19 | 44.63 | 116.37 | 175.91 | 12.38 | 11.95 |
| | G25 | 162.90 | 203.60 | 8.71 | 36.13 | 127.14 | 188.91 | 15.50 | 14.70 |
| | G26 | 168.66 | 212.62 | 9.11 | 31.55 | 138.25 | 194.38 | 13.60 | 13.36 |
| | G27 | 173.25 | 219.87 | 11.29 | 17.16 | 142.74 | 203.15 | 14.60 | 14.57 |
| Comp. | G12 | 175.48 | 212.95 | 21.98 | 52.21 | 119.81 | 180.83 | 24.16 | 20.15 |
| | G13 | 160.91 | 212.84 | 25.45 | 47.72 | | Not Tested | | |
| | G14 | 173.66 | 218.37 | 11.49 | 34.31 | 139.79 | 186.23 | 11.49 | 12.09 |
| | G15 | 147.40 | 208.31 | 17.82 | 20.03 | | Not Tested | | |
| | G21 | 166.80 | 210.04 | 19.60 | 41.58 | 131.12 | 183.44 | 12.70 | 14.36 |
| | G22 | 177.52 | 222.62 | 13.10 | 45.17 | 139.34 | 189.79 | 13.00 | 13.97 |
| | G23 | 163.62 | 215.16 | 17.10 | 23.30 | 143.33 | 201.98 | 16.20 | 16.03 |

The results of elevated temperature tensile testing are set forth in Table 4A below including the 0.2% offset yield strength (YS), the ultimate tensile strength (UTS), the percent elongation (% El), and the percent reduction in cross-sectional area (% RA). In these tests a first set of tensile specimens was tested at a temperature of 1000° F. and a second set of tensile specimens was tested at a temperature of 1300° F.

TABLE 4A

| | | 1000 F. | | | | 1300 F. | | | |
|---|---|---|---|---|---|---|---|---|---|
| | HEAT | YS | UTS | % El | % RA | YS | UTS | % El | % RA |
| Inv. | S31 | 130.44 | 190.96 | 10.27 | 11.85 | 106.72 | 137.86 | 26.93 | 50.47 |
| (H1) | S32 | 114.70 | 166.24 | 15.28 | 32.44 | 100.58 | 127.70 | 22.28 | 35.72 |
| | S66 | 129.16 | 181.89 | 20.69 | 35.00 | 115.54 | 139.83 | 17.33 | 22.27 |
| | G16 | 155.32 | 195.65 | 12.71 | 30.28 | 97.82 | 137.01 | 34.76 | 79.44 |
| | G17 | 155.57 | 204.57 | 13.49 | 35.71 | | Not Tested | | |
| | G18 | 169.59 | 209.96 | 12.29 | 31.29 | 100.20 | 141.05 | 32.83 | 85.12 |
| | G19 | 130.20 | 198.47 | 16.02 | 26.11 | 77.05 | 129.80 | 41.39 | 86.01 |
| | G20 | 134.85 | 174.71 | 16.45 | 28.39 | 117.35 | 153.44 | 19.82 | 20.18 |
| | G24 | 143.02 | 191.03 | 12.11 | 29.99 | 106.71 | 141.07 | 32.11 | 40.31 |
| | G25 | 154.2 | 201.46 | 10.72 | 25.95 | 105.44 | 146.90 | 32.11 | 73.71 |
| | G26 | 142.58 | 192.21 | 7.05 | 15.05 | 105.56 | 143.52 | 36.51 | 98.52 |
| | G27 | 138.93 | 195.32 | 7.53 | 14.22 | 96.97 | 148.34 | 27.47 | 73.20 |

TABLE 4A-continued

| | | 1000 F. | | | | 1300 F. | | | |
|---|---|---|---|---|---|---|---|---|---|
| | HEAT | YS | UTS | % El | % RA | YS | UTS | % El | % RA |
| Comp. | S25 | 107.99 | 173.16 | 18.78 | 32.89 | 95.46 | 132.92 | 6.34 | 12.16 |
| | S26 | 106.90 | 160.41 | 19.20 | 44.27 | 95.40 | 125.53 | 6.76 | 14.24 |
| | S27 | 113.90 | 172.94 | 20.42 | 41.11 | 101.06 | 130.44 | 3.50 | 4.63 |
| | S28 | 115.33 | 174.99 | 18.90 | 43.09 | 104.69 | 132.51 | 5.25 | 10.97 |
| | S29 | 120.48 | 179.02 | 14.25 | 37.52 | 110.84 | 136.20 | 3.26 | 5.65 |
| | S30 | 120.92 | 176.39 | 19.63 | 40.92 | 115.34 | 133.06 | 2.90 | 6.42 |
| | S33 | 117.68 | 179.88 | 17.63 | 32.10 | 113.22 | 144.58 | 4.16 | 11.60 |
| | S34 | 120.71 | 174.98 | 19.93 | 35.36 | 112.75 | 136.36 | 6.80 | 10.99 |
| | S37 | 125.76 | 177.28 | 14.55 | 38.40 | 107.53 | 133.19 | 4.16 | 8.68 |
| | S38 | 122.39 | 177.13 | 17.33 | 48.37 | 111.34 | 133.53 | 3.30 | 9.84 |
| | S39 | 121.79 | 174.00 | 19.38 | 39.83 | 113.24 | 139.63 | 5.50 | 7.04 |
| | S40 | 114.65 | 170.23 | 20.53 | 42.94 | 110.02 | 129.18 | 3.80 | 6.92 |
| | S67 | 120.48 | 172.09 | 26.04 | 38.79 | | Not Tested | | |
| | S68 | 124.10 | 180.78 | 27.82 | 44.26 | 120.42 | 149.63 | 8.02 | 16.37 |
| | S69 | 129.52 | 176.71 | 19.31 | 43.06 | 115.08 | 137.95 | 11.98 | 11.48 |
| | S70 | 121.89 | 169.43 | 20.79 | 47.72 | 107.08 | 133.27 | 8.32 | 16.43 |
| | S44 | 129.84 | 188.18 | 18.54 | 36.89 | 118.25 | 149.96 | 4.10 | 3.94 |
| | G12 | 156.85 | 204.55 | 13.43 | 22.68 | 124.20 | 157.88 | 39.70 | 77.27 |
| | G13 | | Not Tested | | | | Not Tested | | |
| | G14 | 145.13 | 206.96 | 14.10 | 25.59 | 128.36 | 166.26 | 15.00 | 38.07 |
| | G15 | | Not Tested | | | 121.81 | 165.78 | 4.34 | 6.72 |
| | G21 | 156.85 | 204.02 | 11.14 | 26.65 | 118.88 | 156.18 | 32.65 | 65.37 |
| | G22 | 155.61 | 206.17 | 8.8 | 15.58 | 120.20 | 161.13 | 27.17 | 71.19 |
| | G23 | 140.94 | 212.23 | 12.77 | 18.77 | 121.13 | 161.90 | 15.36 | 20.55 |

The results of additional elevated temperature tensile testing of the G-heat samples that were heat treated with H2 are set forth in Table 4B below including the 0.2% offset yield strength (YS), the ultimate tensile strength (UTS), the percent elongation (% El), and the percent reduction in cross-sectional area (% RA).

TABLE 4B

| | | 1000 F. | | | | 1300 F. | | | |
|---|---|---|---|---|---|---|---|---|---|
| | HEAT | YS | UTS | % El | % RA | YS | UTS | % El | % RA |
| Inv. | G16 | 105.87 | 160.99 | 19.58 | 24.29 | 101.25 | 146.95 | 21.69 | 24.30 |
| (H2) | G17 | 113.48 | 165.72 | 16.81 | 21.23 | 106.85 | 151.73 | 20.66 | 24.11 |
| | G18 | 118.07 | 171.82 | 14.1 | 22.15 | 116.10 | 159.27 | 19.70 | 25.55 |
| | G19 | 122.65 | 177.89 | 11.33 | 19.90 | 120.21 | 163.04 | 10.12 | 11.67 |
| | G20 | 103.84 | 154.42 | 26.39 | 35.34 | 108.61 | 155.82 | 15.60 | 19.84 |
| | G24 | | Not Tested | | | 108.17 | 146.82 | 17.11 | 20.67 |
| | G25 | 113.42 | 166.93 | 13.13 | 18.90 | 114.31 | 151.82 | 24.04 | 28.66 |
| | G26 | 121.27 | 174.17 | 11.39 | 15.12 | 117.58 | 157.23 | 18.19 | 18.40 |
| | G27 | 126.18 | 176.51 | 8.19 | 14.36 | 130.71 | 162.25 | 10.48 | 12.02 |
| Comp. | G12 | 101.71 | 151.2 | 27.59 | 37.15 | 97.68 | 143.01 | 15.18 | 18.53 |
| | G13 | | Not Tested | | | | Not Tested | | |
| | G14 | 118.69 | 164.83 | 22.29 | 30.09 | 112.42 | 139.57 | 3.80 | 10.45 |
| | G15 | | Not Tested | | | | Not Tested | | |
| | G21 | 156.85 | 204.02 | 11.14 | 26.65 | 118.88 | 156.18 | 32.65 | 65.37 |
| | G22 | 119.56 | 168.35 | 18.98 | 26.83 | 114.75 | 152.72 | 4.94 | 13.36 |
| | G23 | 122.83 | 174.97 | 18.07 | 27.52 | 99.42 | 143.18 | 13.61 | 23.51 |

The results of stress rupture testing performed at 1350° F. and an applied stress of 80 ksi are presented in Table 5A below including the time to rupture (Life) in hours, the percent elongation (% El) and the percent reduction in cross-sectional area (% RA).

TABLE 5A

| | HEAT | Life | % El | % RA |
|---|---|---|---|---|
| Inv. | S31 | 2.65 | 23.10 | 62.20 |
| (H1) | S32 | 1.52 | 28.30 | 43.70 |
| | S66 | 3.68 | 21.60 | 39.90 |
| | G16 | 1.16 | 22.50 | 69.40 |

TABLE 5A-continued

| | HEAT | Life | % El | % RA |
|---|---|---|---|---|
| | G17 | 1.18 | 39.40 | 77.20 |
| | G18 | 0.99 | 26.60 | 75.00 |
| | G19 | 0.88 | 49.20 | 79.20 |
| | G20 | 14.70 | 28.10 | 51.90 |
| | G24 | 3.15 | 28.30 | 40.00 |
| | G25 | 5.95 | 36.40 | 60.70 |
| | G26 | 3.71 | 27.30 | 70.90 |
| | G27 | 10.70 | 26.00 | 43.00 |
| Comp. | S25 | 0.40 | 6.60 | 9.80 |
| | S26 | 2.06 | 14.60 | 26.10 |
| | S27 | 3.52 | 4.30 | 6.60 |

TABLE 5A-continued

| HEAT | Life | % El | % RA |
|---|---|---|---|
| S28 | 1.03 | 3.70 | 7.90 |
| S29 | 0.92 | 1.40 | 2.30 |
| S33 | 8.41 | 6.10 | 8.30 |
| S34 | 3.32 | 13.90 | 18.90 |
| S30 | 3.24 | 4.30 | 4.70 |
| S37 | 2.72 | 8.00 | 10.20 |
| S38 | 2.98 | 2.90 | 4.40 |
| S39 | 4.68 | 4.30 | 8.70 |
| S40 | 4.60 | 10.60 | 17.40 |
| S67 | 18.60 | 18.20 | 22.00 |
| S68 | 1.33 | 4.40 | 7.20 |
| S69 | 4.70 | 15.30 | 28.20 |
| S70 | 3.38 | 14.60 | 24.00 |
| S44 | 10.50 | 4.00 | 7.70 |
| G12 | 4.31 | 11.00 | 18.50 |
| G13 | 12.00 | 13.00 | 14.50 |
| G14 | 27.20 | 21.60 | 71.00 |
| G15 | 1.14 | 30.40 | 70.00 |
| G21 | 12.30 | 24.60 | 68.20 |
| G22 | 14.70 | 33.40 | 67.40 |
| G23 | 13.20 | 22.30 | 68.30 |

The results of additional stress rupture testing of the G-heat samples that were heat treated with H2 are presented in Table 5B including the time to rupture (Life) in hours, the percent elongation (% El) and the percent reduction in cross-sectional area (% RA).

TABLE 5B

| | HEAT | Life | % El | % RA |
|---|---|---|---|---|
| Inv. | G16 | 37.50 | 16.30 | 17.60 |
| (H2) | G17 | 51.00 | 18.00 | 25.90 |
| | G18 | 62.80 | 26.10 | 37.40 |
| | G19 | 73.00 | 26.40 | 30.00 |
| | G20 | 35.60 | 24.20 | 11.00 |
| | G24 | 30.80 | 7.50 | 8.90 |
| | G25 | 46.70 | 25.60 | 39.80 |
| | G26 | 54.20 | 25.30 | 42.90 |
| | G27 | 57.60 | 27.60 | 38.40 |
| Comp. | G12 | 31.60 | 2.10 | 4.90 |
| | G13 | 51.90 | 1.10 | 3.20 |
| | G14 | 117.00 | 4.30 | 8.70 |
| | G15 | 96.30 | 0.36 | 2.80 |

TABLE 5B-continued

| HEAT | Life | % El | % RA |
|---|---|---|---|
| G21 | 104.00 | 13.00 | 19.50 |
| G22 | 121.00 | 5.60 | 7.50 |
| G23 | 127.00 | 8.00 | 8.70 |

Figure 2:
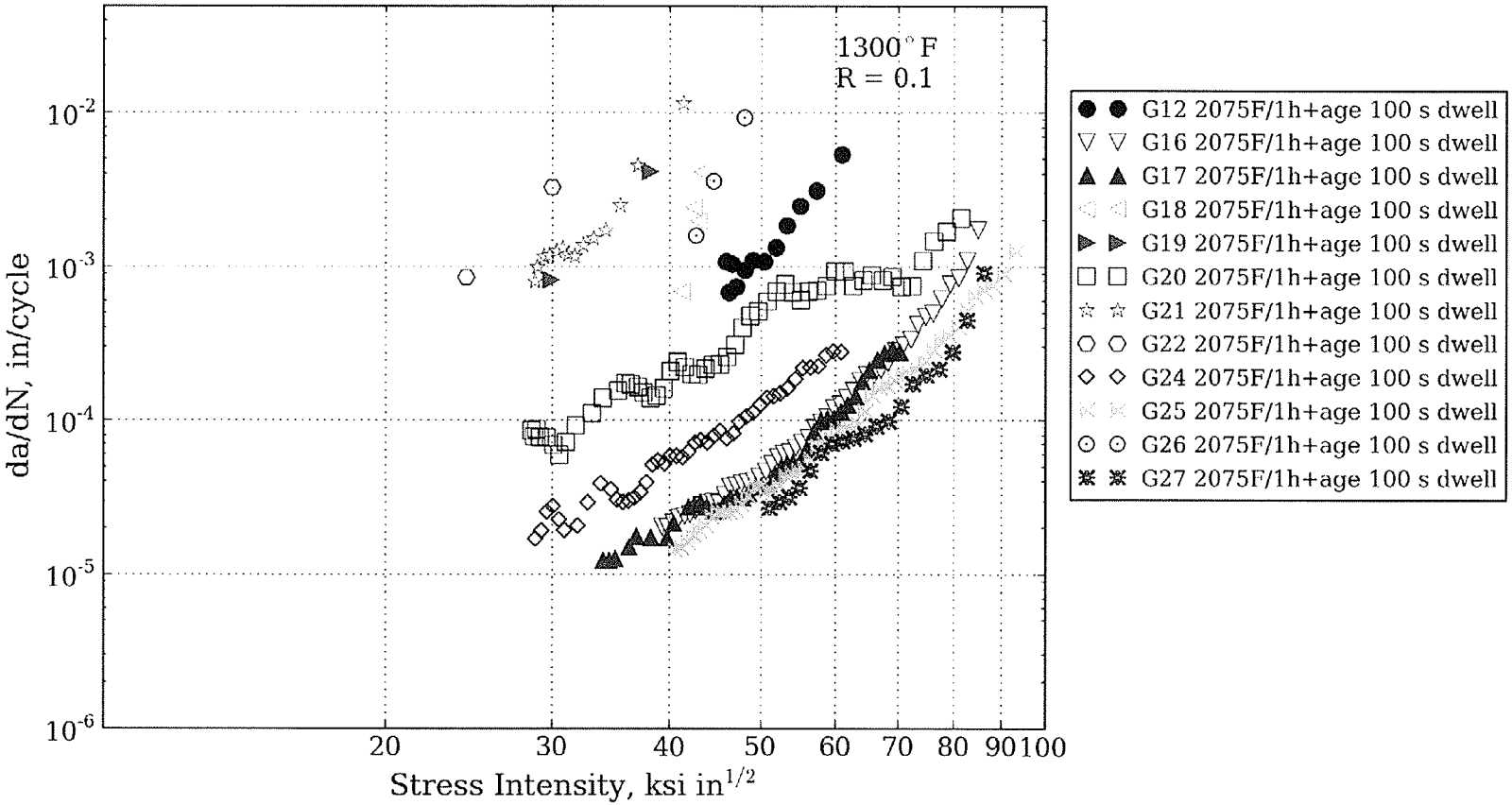
FIG. 2 is a graph of crack growth rate (da/dN) as a function of stress intensity range for the first series of examples that were solution annealed at 2075° F. for 1 hour and then aged.
Figure 3:
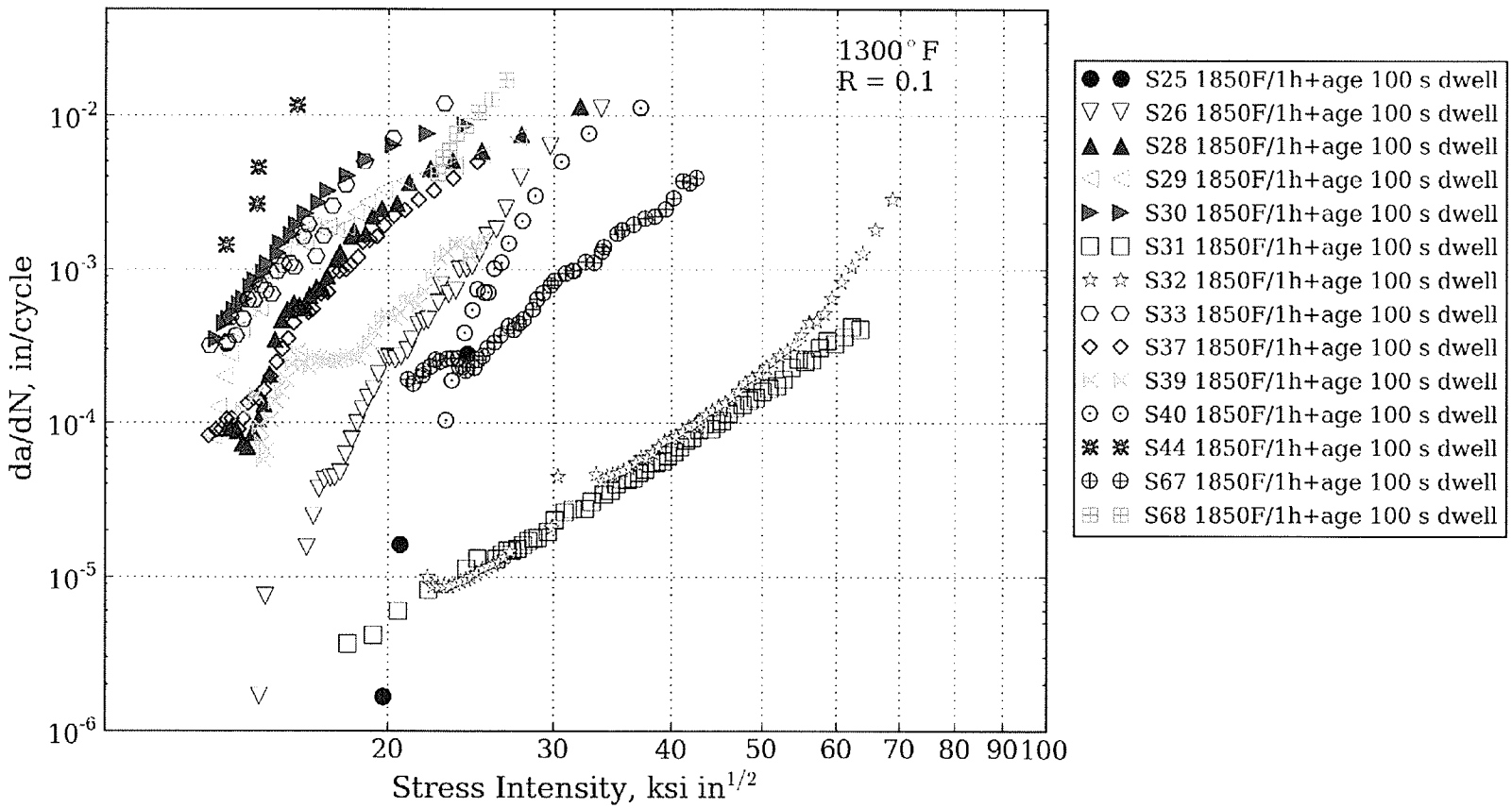
FIG. 3 is a graph of crack growth rate (da/dN) as a function of stress intensity range for a second series of examples that were solution annealed at 1850° F. for 1 hour and then aged.

In addition to the tensile and stress rupture testing, selected samples of the G and S heats were tested for dwell crack growth resistance. The results of the crack growth resistance testing are shown in FIGS. 1-3. FIG. 1 includes a graph of the line that is defined by the equation $da/dN=1.2\times10^{-10}\times\Delta K^{4.3}$ compared to the graphs for the examples that were tested.

Example II

Additional testing was performed to demonstrate the benefits of the modified heat treatment according to the present invention. The testing was performed on samples of alloy G27, the composition of which is set forth in Table 1 above. The onset of the γ' solvus was 1845° F. as determined by differential scanning calorimetry with a heating rate of 36° F./min. The samples were heat treated using several different heat treatments including single and double annealing treatments as shown in Table 6 below. Heat treatments HT-1 to HT-6 included a single annealing treatment at a temperature above the solvus temperature. Heat treatments HT-7 to HT-9 included a single annealing treatment at a temperature below the solvus temperature. Heat treatments HT-10 to HT-17 included a double annealing treatment consisting of a supersolvus anneal followed by a subsolvus anneal. All heat treatments included a standard aging treatment as described above.

Table 6 below shows the results of elevated temperature tensile testing at 1300° F. including the yield strength (Y.S.) and tensile strength (U.T.S.) in ksi, the percent elongation (% El.), and the percent reduction in area (% R.A.) on the several heat treated samples. Also shown in Table 6 are the results of stress rupture testing including the stress rupture life in hours at 1350° F. under 80 ksi load (TTF). The values reported in Table 6 are the average of measurements taken on duplicate samples, except HT-1. A single sample was tested for HT-1.

TABLE 6

| HT I.D. | Heat Treatment | Anneal | Y.S. | T.S. | % El. | % R.A. | TTF |
|---|---|---|---|---|---|---|---|
| 1 | 2075 F./1 h/OQ + WQ Age | Supersolvus | 130.7 | 162.3 | 10.5 | 12.0 | 57.6 |
| 2 | 2075 F./1 h/OQ + FC Age | Supersolvus | 128.3 | 154.3 | 9.0 | 8.5 | — |
| 3 | 1850 F./1 h/OQ + FC Age | Supersolvus | 138.5 | 158.3 | 6.2 | 8.5 | 17.5 |
| 4 | 1850 F./1 h/OQ + 1400 F./16 h/AC | Supersolvus | 141.3 | 167.6 | 6.2 | 12.4 | 29.3 |
| 5 | 1850 F./1 h/OQ + WQ Age | Supersolvus | 136.3 | 159.5 | 5.9 | 7.5 | — |
| 6 | 1850 F./1 h/SC + FC Age | Supersolvus | 129.3 | 153.5 | 7.8 | 10.0 | — |
| 7 | 1825 F./1 h/OQ + FC Age | Subsolvus | 117.5 | 149.8 | 51.3 | 74.0 | — |
| 8 | 1800 F./1 h/OQ + FC Age | Subsolvus | 110.3 | 146.4 | 40.4 | 75.3 | 5.21 |
| 9 | 1750 F./1 h/OQ + FC Age | Subsolvus | 101.0 | 142.8 | 39.8 | 70.3 | 4.91 |
| 10 | 2075 F./1 h/OQ + 1800 F./4 h/OQ + WQ Age | Double | 123.0 | 153.0 | 14.8 | 18.0 | 30.0 |
| 11 | 2000 F./1 h/OQ + 1800 F./4 h/OQ + WQ Age | Double | 122.8 | 153.8 | 19.0 | 15.8 | 26.8 |
| 12 | 2075 F./1 h/OQ + 1800 F./8 h/OQ + WQ Age | Double | 124.3 | 153.8 | 12.5 | 13.5 | — |
| 13 | 2075 F./1 h/OQ + 1700 F./8 h/OQ + WQ Age | Double | 103.0 | 144.0 | 18.3 | 19.3 | — |
| 14 | 2000 F./1 h/OQ + 1800 F./8 h/OQ + WQ Age | Double | 124.0 | 153.0 | 10.8 | 12.5 | — |
| 15 | 2075 F./1 h/FC + 1800 F./4 h/OQ + WQ Age | Double | 128.8 | 155.0 | 5.0 | 9.0 | — |
| 16 | 2075 F./1 h/OQ + 1800 F./4 h/FC + WQ Age | Double | 98.8 | 142.3 | 19.0 | 24.8 | — |
| 17 | 1850 F./1 h/FC + 1800 F./4 h/OQ + FC Age | Double | 132.0 | 154.3 | 14.3 | 12.3 | — |

None of the heat treatments that used a supersolvus annealing temperature met the tensile ductility objective for this alloy. HT-1 through HT-5 show variations in the annealing temperature and aging procedure, yet ductility at acceptable levels was not achieved. A slow cool (SC) from the supersolvus annealing temperature to room temperature (HT-6) was also not effective to provide the desired ductility. Subsolvus annealing heat treatments used in HT-7, HT-8, and HT-9 resulted in improved ductility, but the yield strength decreased to less than 120 ksi and the stress rupture life was not acceptable.

A comparison of the results for HT-1 to the results for HT-10 shows that the addition of a second annealing step below the solvus temperature resulted in significantly increased ductility. The percent elongation increased from 10.5% to 14.8% and the percent reduction in area increased from 12% to 18%. The ductility provided after HT-10 exceeds the minimum acceptable ductility provided by a known superalloy. Although the tensile strength and stress rupture life after HT-10 are lower than after HT-1, the stress rupture life provided still exceeds the stress rupture life provided by another known superalloy.

The results for HT-11 show that the double anneal can be used with a lower temperature supersolvus temperature. The results for HT-12 and HT-14 demonstrate that extended times at the second annealing temperature may result in a lessening of the beneficial effect when close to the solvus temperature. The results for HT-13 show that conducting the second anneal at a temperature farther below the solvus temperature for the second anneal with extended time at temperature results in a further increase in ductility, but with a concomitant reduction in strength. The use of a 100° F./h furnace cool after the first annealing temperature eliminated any gains in ductility as shown by the results for HT-15. However, when the same furnace cool was used only after the second annealing temperature as in HT-16, a relatively high ductility was obtained, albeit with substantially lower strength. The results after HT-17 demonstrate that % elongation can be significantly increased when a second anneal of 1800° F. is used in combination with an first 1850° F. anneal, as compared to a single 1850° F. anneal (HT-3).

The terms and expressions which are employed in this specification are used as terms of description and not of limitation. There is no intention in the use of such terms and expressions of excluding any equivalents of the features shown and described or portions thereof. It is recognized that various modifications are possible within the invention described and claimed herein.

The invention claimed is:

1. A nickel-base superalloy that provides a combination of high strength, good creep resistance, and good resistance to crack growth, said alloy consisting essentially of, in weight percent:

C about 0.005 to about 0.1
Cr about 13 to about 17
Fe about 4 to about 20
Mo about 3 to about 9
W up to about 8
Co up to about 8
Al about 1 to about 3
Ti about 0.6 to about 3
Nb up to about 5.5
B about 0.001 to about 0.015
Mg about 0.0001 to about 0.0050
Zr about 0.001 to about 0.08
Si up to about 0.7
P up to about 0.05 and the balance is nickel, usual impurities, and minor amounts of other elements as residuals from alloying additions during melting.

2. The alloy as claimed in claim 1 which contains at least about 0.01% carbon.

3. The alloy as claimed in claim 1 which contains at least about 14% chromium.

4. The alloy as claimed in claim 1 which contains at least about 3.5% molybdenum.

5. The alloy as claimed in claim 1 which contains not more than about 17% iron.

6. The alloy as claimed in claim 1 which contains at least about 1% niobium.

7. The alloy as claimed in claim 1 which contains at least about 1% titanium.

8. A nickel-base superalloy that provides a combination of high strength, good creep resistance, and good resistance to crack growth, said alloy consisting essentially of, in weight percent:

C about 0.01 to about 0.05
Cr about 14 to about 16
Fe about 8 to about 17
Mo about 3.5 to about 8
W up to about 4
Co up to about 8
Al about 1.5 to about 2.5
Ti about 1 to about 2.5
Nb about 1 to about 5
B about 0.003 to about 0.010
Mg about 0.0001 to about 0.0020
Zr about 0.015 to about 0.06
Si up to about 0.7
P up to about 0.05 and the balance is nickel, usual impurities, and minor amounts of other elements as residuals from alloying additions during melting.

9. The alloy as claimed in claim 8 which contains at least about 0.02% carbon.

10. The alloy as claimed in claim 8 which contains at least about 14.5% chromium.

11. The alloy as claimed in claim 8 which contains at least about 3.8% molybdenum.

12. The alloy as claimed in claim 8 which contains not more than about 16% iron.

13. The alloy as claimed in claim 8 which contains up to about 5% cobalt.

14. The alloy as claimed in claim 8 which contains at least about 2% niobium.

15. The alloy as claimed in claim 8 which contains at least about 1.5% titanium.

16. A nickel-base superalloy that provides a combination of high strength, good creep resistance, and good resistance to crack growth, said alloy consisting essentially of, in weight percent:

C about 0.02 to about 0.04
Cr about 14.5 to about 15.5
Fe about 9 to about 16
Mo about 3.8 to about 4.5
W up to about 3
Co up to about 5
Al about 1.8 to about 2.2
Ti about 1.5 to about 2.1
Nb about 2 to about 4.5
B about 0.004 to about 0.008
Mg about 0.0001 to about 0.0016

Zr about 0.02 to about 0.04
Si up to about 0.7
P up to about 0.05 and the balance is nickel, usual impurities, and minor amounts of other elements as residuals from alloying additions during melting.

17. An article of manufacture having a combination of high strength, good creep resistance, and good resistance to crack growth, said article being made from a nickel-base superalloy that consists essentially of, in weight percent:

C about 0.005 to about 0.06
Cr about 13 to about 17
Fe about 4 to about 20
Mo about 3 to about 9
W up to about 8
Co up to about 8
Al about 1 to about 3
Ti about 0.6 to about 3
Nb up to about 5.5
B about 0.001 to about 0.012
Mg about 0.0001 to about 0.0020
Zr about 0.01 to about 0.08
Si up to about 0.7
P up to about 0.05 and the balance is nickel, usual impurities, and minor amounts of other elements as residuals from alloying additions during melting, wherein said alloy is characterized by a solvus temperature.

18. An article of manufacture having a combination of high strength, good creep resistance, and good resistance to crack growth, said article being made from a nickel-base superalloy that consists essentially of, in weight percent:

C about 0.01 to about 0.05
Cr about 14 to about 16
Fe about 8 to about 17
Mo about 3.5 to about 8
W up to about 4
Co up to about 8
Al about 1.5 to about 2.5
Ti about 1 to about 2.5
Nb about 1 to about 5
B about 0.003 to about 0.010
Mg about 0.0001 to about 0.0020
Zr about 0.015 to about 0.06
Si up to about 0.7
P up to about 0.05 and the balance is nickel, usual impurities, and minor amounts of other elements as residuals from alloying additions during melting, wherein the alloy has a γ' solvus temperature not greater than about 1860° F.

19. An article of manufacture having a combination of high strength, good creep resistance, and good resistance to crack growth, said article being made from a nickel-base superalloy that consists essentially of, in weight percent:

C about 0.01 to about 0.05
Cr about 14 to about 16
Fe about 8 to about 17
Mo about 3.5 to about 8
W up to about 4
Co up to about 8
Al about 1.5 to about 2.5
Ti about 1 to about 2.5
Nb about 1 to about 5
B about 0.003 to about 0.010
Mg about 0.0001 to about 0.0020
Zr about 0.015 to about 0.06
Si up to about 0.7
P up to about 0.05 and the balance is nickel, usual impurities, and minor amounts of other elements as residuals from alloying additions during melting, wherein the alloy has a γ' solvus temperature greater than about 1880° F. and when the article is annealed at a temperature below the solvus temperature, the alloy contains not more than about 1% tungsten.

* * * * *